US008062197B2

(12) United States Patent
Shinomiya et al.

(10) Patent No.: US 8,062,197 B2
(45) Date of Patent: Nov. 22, 2011

(54) EXERCISE ASSISTING DEVICE

(75) Inventors: Youichi Shinomiya, Ibaraki (JP); Takahisa Ozawa, Katano (JP); Kazuhiro Ochi, Osaka (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 0 days.

(21) Appl. No.: 12/680,730

(22) PCT Filed: Apr. 23, 2008

(86) PCT No.: PCT/JP2008/057811

§ 371 (c)(1),
(2), (4) Date: Mar. 29, 2010

(87) PCT Pub. No.: WO2008/133260

PCT Pub. Date: Nov. 6, 2008

(65) Prior Publication Data

US 2010/0222191 A1 Sep. 2, 2010

(30) Foreign Application Priority Data

Apr. 23, 2007 (JP) ..... 2007-113457

(51) Int. Cl.
*A63B 26/00* (2006.01)

(52) U.S. Cl. ..... 482/142

(58) Field of Classification Search ..... 482/142, 482/148, 139, 51, 34; 472/29, 96, 97, 95, 472/130, 59–61; 446/313, 28, 7, 29, 396; 434/55, 62, 64–65, 247; 297/260.1–260.2; 473/97; *A63B 23/04, 23/00, 24/00; A63H 11/00*
See application file for complete search history.

(56) References Cited

U.S. PATENT DOCUMENTS

| | | | | |
|---|---|---|---|---|
| 7,121,831 | B2 * | 10/2006 | Hojo et al. | 434/247 |
| 7,347,806 | B2 * | 3/2008 | Nakano et al. | 482/51 |
| 7,608,017 | B2 * | 10/2009 | Nakanishi | 482/51 |
| 7,682,154 | B2 * | 3/2010 | Hojo et al. | 434/247 |
| 7,775,939 | B2 * | 8/2010 | Nakanishi | 482/51 |
| 2002/0115536 | A1 * | 8/2002 | Hojo et al. | 482/51 |
| 2008/0200266 | A1 * | 8/2008 | Chuang et al. | 472/29 |

FOREIGN PATENT DOCUMENTS

| | | | |
|---|---|---|---|
| JP | 2005-58733 | A | 3/2005 |
| JP | 3846499 | B2 | 9/2006 |
| JP | 2007-89650 | A | 4/2007 |
| TW | I270394 | | 1/2007 |

OTHER PUBLICATIONS

International Search Report for the Application No. PCT/JP2008/057811 mailed Jun. 3, 2008.
Taiwanese Office Action for the Application No. 097114794 from Taiwanese Patent Office dated May 11, 2011.

* cited by examiner

*Primary Examiner* — Lori Baker
(74) *Attorney, Agent, or Firm* — Cheng Law Group, PLLC

(57) ABSTRACT

The invention has an object of providing an exercise assisting device which allows the user's thigh to contract while having a simple structure with low manufacturing cost. The device comprising a seat member and a seat drive unit. The seat member has a bearing surface configured to support buttocks of a user with one' feet placed on a predetermined foot rest. The seat drive unit is configured to activate a driving source to displace the seat member in such a manner as to vary a user's own weight acting on legs of the user. The seat drive unit swings the seat member at least along a lateral direction.

7 Claims, 12 Drawing Sheets

EXERCISE ASSISTING DEVICE

TECHNICAL FIELD

The present invention relates to a passive exercise assisting device that varies a user's own weight that acts on the legs of the user by displacing a seat member using a driving source with the user's feet placed on a foot rest and the user's buttocks supported by the seat member.

BACKGROUND ART

Japanese Patent Application Laid-open No. 2005-58733 (Document 1) and Japanese Patent Application Laid-open No. 2007-89650 (Document 2) propose an exercise assisting device that tightens and relaxes muscle groups of the thighs without hardly any bending or stretching of the knees by displacing a seat member provided therein with the feet of a user placed on a foot rest and the buttocks of the user supported by a bearing surface of the seat member. This exercise assisting device varies the user's own weight that acts on the legs by displacing the position of the seat member to vary the proportion of the user's body weight that supports the seat member.

According to this operation, together with reducing the load on the user's legs as compared to that in the case of allowing the user's entire body weight to act thereon, muscles of the thighs can be contracted without hardly any bending or stretching of the knees, thereby making it possible to strengthen muscle groups of the thighs even for users having knee pain in the manner of diabetes patients, for example. Moreover, since muscle groups of the thighs have large volume, use of this device is expected to contribute to improvement of lifestyle diseases due to metabolism of sugar accompanying muscle contraction. What is more, since the user can exercise passively without having to spontaneously exert muscle force by allowing the seat member to be displaced by a driving source, coupled with the light load, even users whose motor functions have been diminished are able to use the device.

However, since the exercise assisting device having the configuration described above allows muscle groups of the thighs to be tightened and relaxed by varying the user's own weight that acts on the legs with the knee joints bent at a predetermined angle unaccompanied by hardly any bending or stretching of the knees in the manner of so-called squat exercises that do not involve bending or stretching, this device offers the advantage of enabling even users having knee pain to strengthen muscle groups of the thighs.

On the other hand, in the case of ordinary users who do not have knee pain, an exercise device is sought that provides exercise effects even if there is some degree of bending and stretching of the knee joints during exercise, and low price and compact size are frequently used as conditions for selecting such a device. However, according to the technology described in Document 1 and Document 2 above, in order to allow exercising without varying the bending angle of the knees, the device has problems that result in the use of a large number of components and large size, such as restrictions on the direction of movement of the seat member and the need for a mechanism to vary the positions of the feet accompanying swinging of the seat member.

DISCLOSURE OF THE INVENTION

With the foregoing in view, an object of the present invention is to provide an exercise assisting device that enables the same exercising effects as those of the device described in Documents 1 and 2 to be obtained while also being able to realize a simple structure, reduce the number of components and reduce production costs.

The exercise assisting device as claimed in the present invention comprises a seat member having a bearing surface configured to support the buttocks of a user with the user's feet placed on a predetermined foot rest, and a seat drive unit configured to activate a driving source to displace the seat member in such a manner as to vary the user's own weight acting on the legs of the user, wherein the seat drive member is configured to swing the seat member at least along a lateral direction. Thus, in the device of the present invention, since the seat drive unit is only required to swing the seat member at least along the lateral direction, although motion is imparted that is accompanied by bending and stretching of the knee joint due to swinging in the lateral direction, the device can be used by ordinary users not having knee pain. In addition, since the user's feet are supported by the foot rest, the load that acts on the user's legs varies accompanying movement of the seat member in the lateral direction, thereby allowing the obtaining of exercise effects through muscle contraction of muscle groups of the thighs. Moreover, since the user is able to exercise passively as a result of the seat member being driven by the driving source, the user is able to exercise more easily than in the case of spontaneous exercise, thereby enabling the device to be used easily even by users having low exercise capacity. Since there are no restrictions other than the swinging direction of the seat member being in the lateral direction, and there are no restrictions on the foot rest with the exception of having to place the feet thereon, the device can be realized in a simple configuration. Namely, the number of components, size and price can be reduced.

The seat drive unit is preferably provided with a linear drive configured to swing the seat member along a linear path in the lateral direction. In this case, since the seat member swings along a linear path in the lateral direction, in the case of using a rotating motor for the driving source, the device can be easily realized simply by using a mechanism such as a cylindrical cam or crank that converts rotary motion to linear motion. Moreover, since the seat member moves along a linear path in the lateral direction, changes in the load that acts on the left and right legs of the user accompanying displacement of the seat member are comparatively small, thereby enabling even beginners having low exercise capacity to exercise by tightening and relaxing muscle groups of the thighs under a light load.

In addition, the seat driving unit is preferably provided with an inclination drive configured to swing the seat member in such a manner as to incline the bearing surface with respect to the lateral direction accompanied with a change in relative position between heights at the lateral ends of the seat member. In this case, the seat drive member can be easily realized simply by using a rotating motor for the driving source and using a mechanism such as a cam or crank that converts continuous rotation to reciprocal rotation. Moreover, since the bearing surface of the seat member displaces the user's upper body so as to be inclined accompanying rolling, changes in the load that acts on the left and right legs of the user accompanying movement of the seat member are comparatively large, thereby making it possible to obtain greater exercise effects.

Moreover, the seat drive unit is preferably provided with a fore-aft drive configured to displace the seat member with respect to a lengthwise direction in an interlocked manner with the lateral swinging movement in the lateral direction. As a result of employing this configuration, the seat member is displaced not only in the lateral direction but also in the lengthwise direction, thereby enabling changes in the load that acts on the legs of the user to be even greater in comparison with the case of the seat member only swinging in the lateral direction.

The seat drive unit can also be configured so as to be provided with a linear drive configured to swing the seat member along a linear path along the lateral direction, and a fore-aft drive configured to displace the seat member with respect to a lengthwise direction. This fore-aft drive is composed of the fore-aft drive having a pitch axle which pivotally supports the seat member to permit the seat member rotate about the pitch axle, and a pitch converter configured to generate a rotating force of rotating the seat member about the pitch axle in association with the lateral movement of the seat member along the linear path caused by the linear drive. In this case, together with the seat member moving linearly in the lateral direction, driving force of the linear motion is converted to rotating force by the fore-aft drive, and the seat member rotates about the pitch axle. As a result, linear movement of the seat member in the lateral direction and displacement of the seat member in the lengthwise direction can be carried out in mutual conjunction. The pitch converter can be easily realized by converting linear motion to rotary motion using a mechanism equivalent to a cam. Consequently, the drive source is only required to be provided for the linear drive, thereby enabling exercise consisting of displacement in the lateral direction and pitching while using only one driving source. In this operation, since the amount of change in the load that acts on the user's legs can be increased as compared with the case of displacing the seat member only along a linear path in the lateral direction or the case of only displacing the seat member by rolling, greater exercise effects are obtained.

Moreover, the seat drive unit is preferably configured so as to reciprocate the seat member in an equal amount from a neutral point along lateral direction, and as a result of employing this configuration, an equal load can be allowed to act on the left and right legs of the user.

In addition, the bearing surface of the seat member is preferably shaped to give the bearing surface which positions the user's knee at a height lower than the user's buttocks when the seat member is displaced to the lateral ends during its swinging movement. Consequently, the proportion of the user's own weight that is supported by the seat member decreases (or in other words, the angle of inclination of the bearing surface in contact with the buttocks of the user relative to the horizontal plane increases thereby increasing the force that acts in a direction along the bearing surface due to the user's own weight), and the load that acts on the legs of the user increases correspondingly, thereby making it possible to enhance exercise effects.

Moreover, the seat member is preferably shaped to give the bearing surface of which front end positioned lower than ist rear end when the seat member is in a neutral position within the lateral swinging range of the seat member. Namely, since the bearing surface is inclined even when the seat member is at the center position of the swinging range thereof in the lateral direction, and the load acting on the legs of the user is at its minimum when the user's buttocks are supported by the bearing surface of the seat member, a load attributable to the user's own weight is always acting on the user's legs and there is no time at which the user's entire weight is supported by the seat member, thereby making it possible to exercise under a high exercise load.

BEST MODE FOR CARRYING OUT THE INVENTION

First Embodiment

Figure 1A:
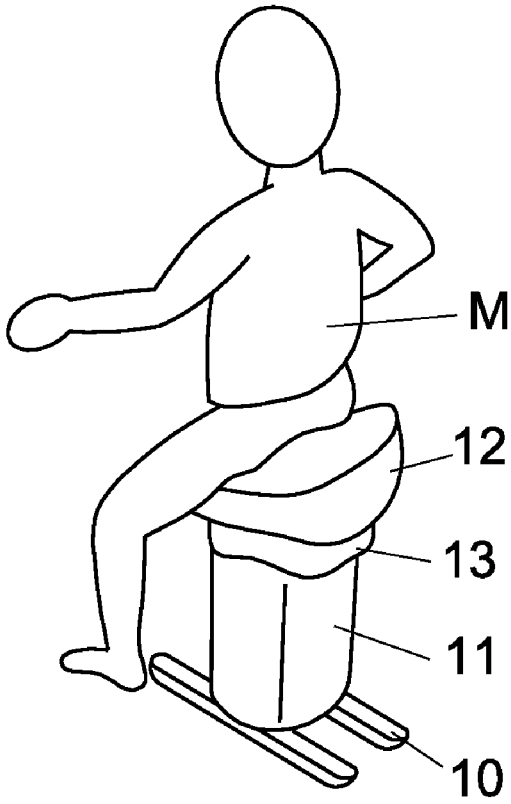
FIGS. 1(*a*) and 1(*b*) show a perspective view and frontal view of the manner in which an exercise assisting device as claimed in the present invention is used.
Figure 1B:
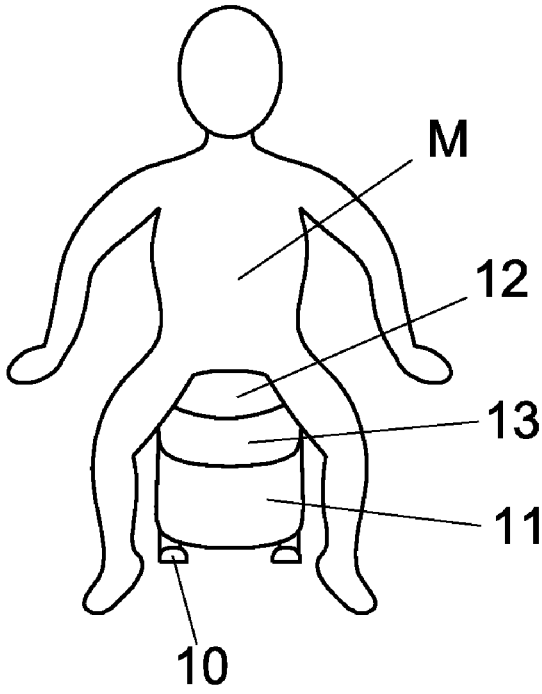
Figure 2:
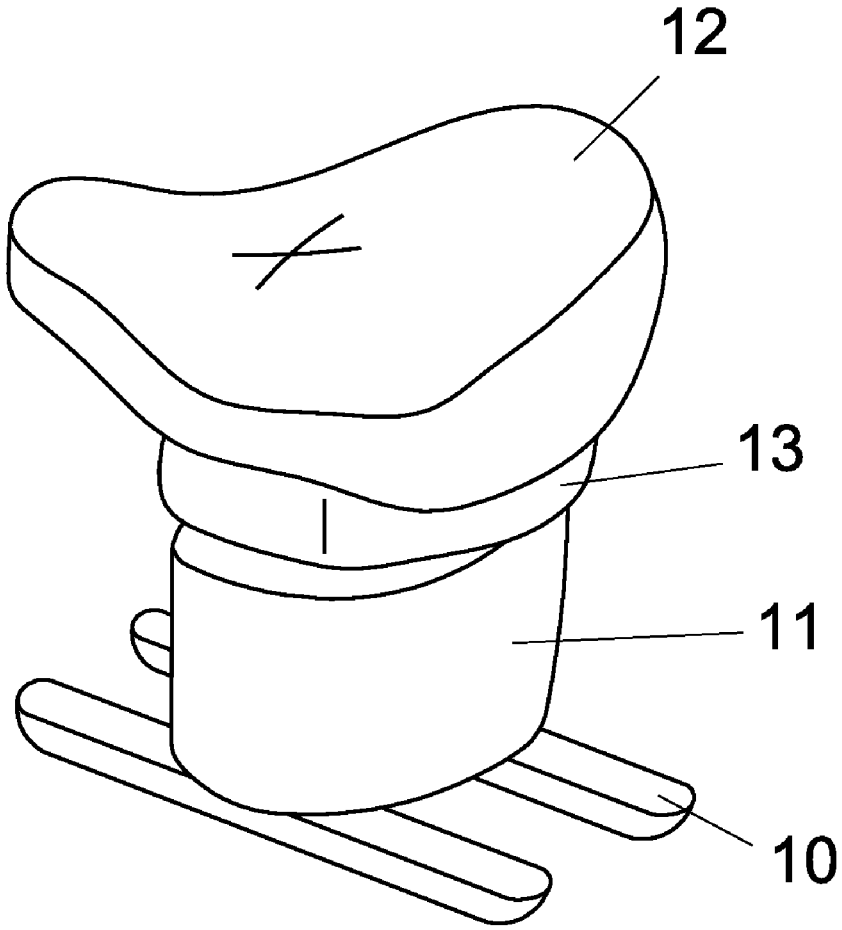
FIG. 2 shows a perspective view of the exercise assisting device shown in the above drawings.

An exercise assisting device in accordance with a first embodiment of the present invention includes, as shown in FIGS. 1 and 2, a base 10 mounted at a fixed position on an installation site such as a floor, and a frame 11 upstanding from the base 10. A seat member 12 is located upwardly of the frame 11 for supporting buttocks of a user M with a seat drive unit 13 interposed between the frame 11 and the seat member 12 for swinging the seat member 12. A structure of the seat drive unit 13 will be explained later.

When using this exercise assisting device, as shown in FIG. 1, the feet are placed on a foot rest using a ground surface such as a floor as a foot rest, and while in this state, the user M's own weight that acts on his or her legs is varied by causing the seat member 12 to swing. When the seat member 12 is swung back and forth with the user M's feet placed on the foot rest and the knee joints bent, since the knees are bent in advance in the manner of squat exercises, the load that acts on the thighs changes accompanying a change in the user M's own weight that is supported by the buttocks of the user M with the seat member 12.

Thus, the load decreases as the bending angle of the knees becomes smaller, the thighs are roughly perpendicular to the installation site, and the load increases as the bending angle of the knees approaches 90 degrees. In the example of use shown in FIG. 1, since there are no particular restrictions on the positions of the feet, the size of the load that acts on the thighs varies according to the position where the user M places his or her feet.

Figure 3:
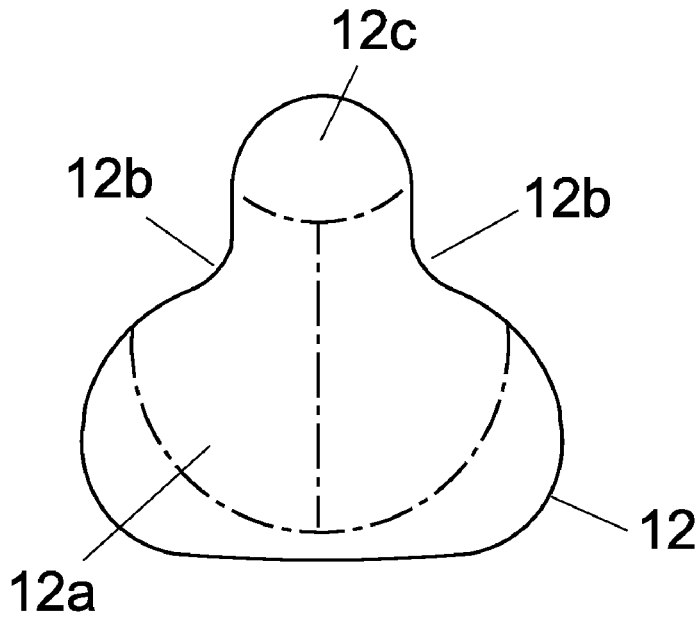
FIGS. 3(*a*) and 3(*b*) show an overhead view and perspective view of a seat member used in the device shown in the above drawings.
Figure 3:
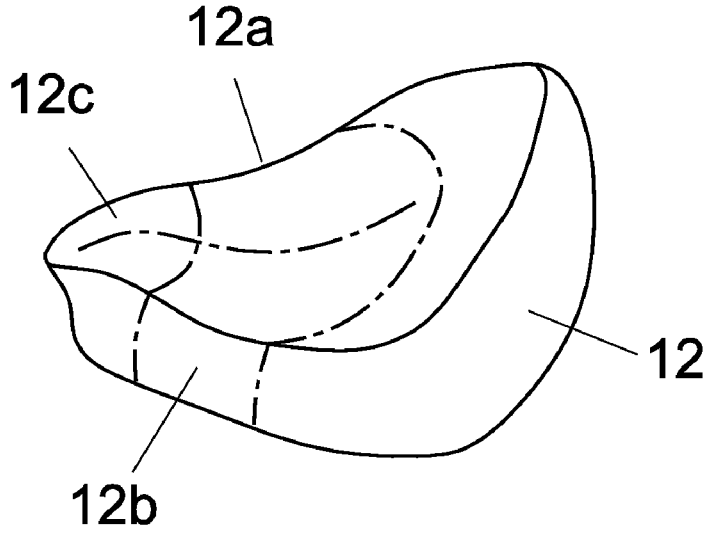

As shown in FIG. 3, a seat member can be employed for the seat member 12 in which the overall shape when viewed from overhead is triangular. A portion of the upper surface of this seat member 12 consists of a bearing surface 12*a* that supports the buttocks of the user M, and the bearing surface 12*a* is curved so that the height of the front end is lower than the height of the rear end. The top of FIG. 3(*a*) indicates the front end of the seat member 12, and the bearing surface 12*a* is the surface between the single dot broken lines in the front and rear. In addition, the center of the bearing surface 12*a* in the lateral direction is somewhat higher than both sides thereof. FIGS. 3(*a*) and 3(*b*) show a ridge line indicated with single dot broken lines in the center of the seat member 12 in the lateral direction. In addition, curved concave portions 12*b* are formed in the periphery of the seat member 12 so as to indicate the positions of the thighs of the left and right legs. Moreover, a retaining portion 12*c* is formed on the front end of the seat member 12 that is higher than the bearing surface 12*a* and prevents the buttocks from shifting position.

Figure 4:
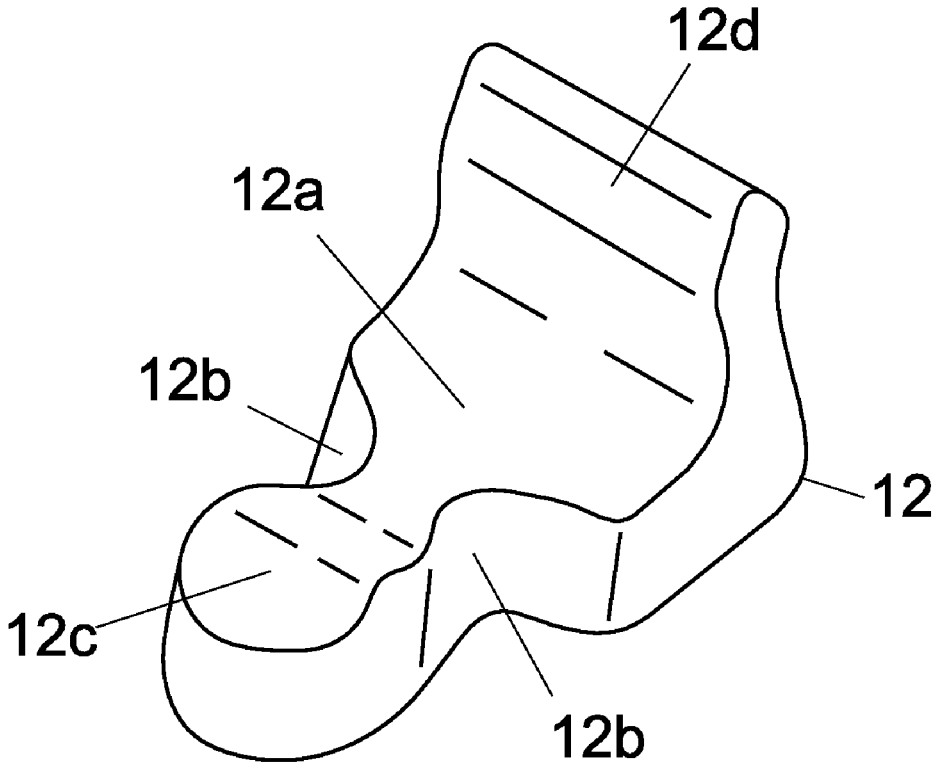
FIG. 4 shows a perspective view of another example of a seat member used in the device shown in the above drawings.

For the seat member 12, as shown in FIG. 4, a flat surface may also be used for the bearing surface 12*a*, A backrest 12*d*, which contacts the lower back of a user when the buttocks are supported by the bearing surface 12*a*, is formed in this seat member 12, thereby preventing the buttocks from shifting to the rear relative to the seat member 12.

Figure 5:
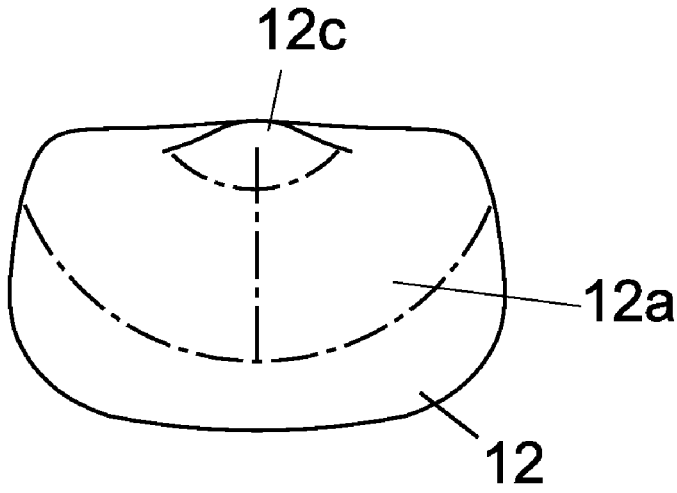
FIGS. 5(*a*) and 5(*b*) show an overhead view and perspective view of still another example of a seat member used in the device shown in the above drawings.
Figure 5:
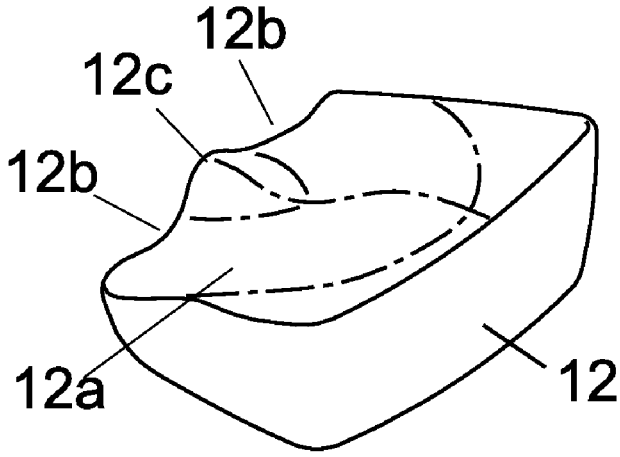
Figure 6:
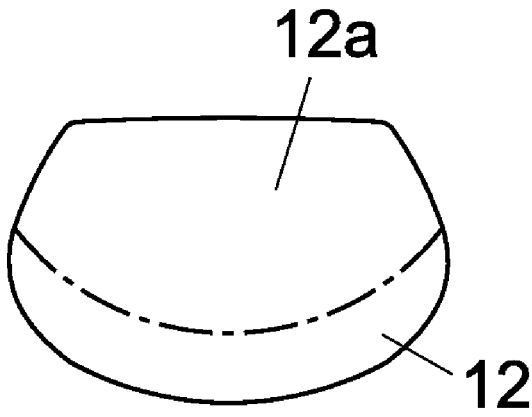
FIGS. 6(*a*) and 6(*b*) show an overhead view and perspective view of different example of a seat member used in the device shown in the above drawings.
Figure 6:
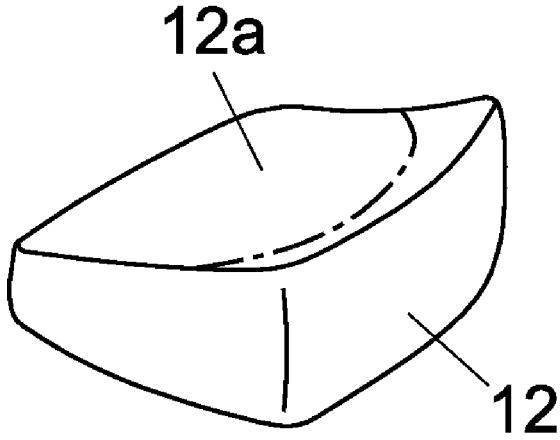
Figure 7:
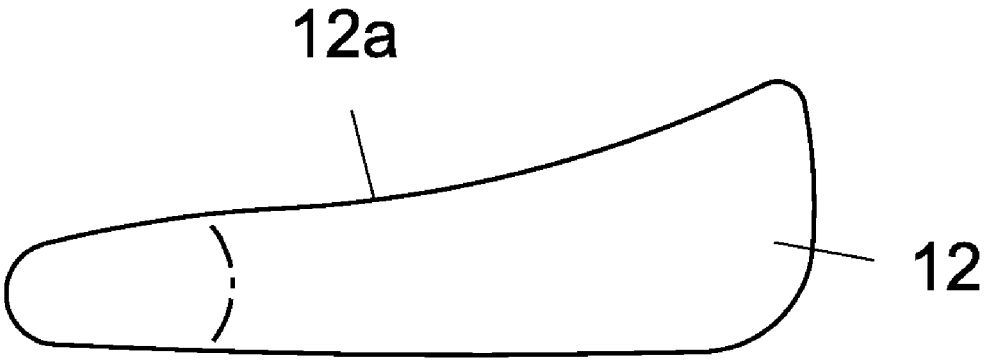
FIG. 7 shows a side view of the seat member shown in FIGS. 6(*a*) and 6(*b*)

Moreover, the shape shown in FIG. 5 can also be used for the seat member 12. In this seat member 12, the retaining portion 12*c* is formed to be smaller than that of the seat member 12 shown in FIG. 3. FIGS. 6 and 7 show an example of the seat member 12 having a simpler shape. The bearing surface 12*a* of this seat member 12 is flat, and the concave portions 12*b* have been omitted. Thus, the bearing surface 12*a* is formed in the form of an inclined surface that inclines downward from the rear to the front.

As has been described above, by using the seat member 12 having a shape in which the height of the front of the bearing surface 12*a* is lower than the height of the rear end thereof, the load that acts on the legs when the buttocks of the user M are supported by the seat member 12 can be increased as compared with the case of using the seat member 12 in which the front and rear heights thereof are equal, thereby making it possible to effectively enhance exercise effects.

However, the present embodiment employs a configuration in which the seat member 12 moves along a linear path in the lateral direction. Although the seat member 12 preferably reciprocates equally in the lateral direction, in order to exercise the right leg or left leg only, a configuration can also be employed in which the seat member 12 is displaced to the right or left side from the center position.

As is clear from the above-mentioned configuration, when the seat member 12 is located in the center position of the swinging range thereof, or in other words, when this seat member is located in the center of the swinging range in the lateral direction (and when in this position, the bearing surface 12*a* of the seat member 12 is laterally symmetrical relative to the vertical plane when viewed from the front), the height of the front of the bearing surface 12*a* of the seat member 12 is lower than the height of the rear. In other words, when the load acting on the legs of the user M is at a minimum while the buttocks of the user M are supported by the bearing surface 12*a* of the seat member 12, since the height of the front of the bearing surface 12*a* is positioned at a lower height than the rear thereof, a load generated according to the user M's own weight constantly acts on the legs of the user M. According to this configuration, an exercise load can be increased without the occurrence of a time when the entire weight of the user M is supported by the seat member 12.

In order to achieve the relationship between the heights of the front and rear of the bearing surface 12*a* as described above, in addition to being able to accommodate this according to the shape of the seat member 12, this can also be accommodated according to the shape of each member present between the base 10 and the seat member 12. For example, a relationship may be employed in which the upper surface of the frame 11 is formed so that the front is positioned lower than the rear, or the upper surface of the seat drive unit 13 is formed so that the front is positioned lower than the rear.

In addition, by employing a configuration in which the center of the bearing surface 12*a* of the seat member 12 in the lateral direction is higher than both sides thereof as previously described, since on the bearing surface 12*a* the heights of the sides of the seat member 12 in the form of the sides facing the knees of the user M (consisting of the right knee side when the seat member 12 has moved to the right, and the left knee side when the seat member 12 has moved to the left) are lower than the center of the seat member 12 that supports the buttocks of the user M when the seat member 12 is positioned at both ends of the swinging range thereof in the lateral direction, the proportion of the user M's own weight that is supported by the seat member 12 decreases, resulting in a corresponding increase in the load that acts on the legs of the user and thereby making it possible to increase exercise effects. This effect can be expected to be further enhanced in a configuration in which the inclination of the bearing surface 12*a* of the seat member 12 changes as in the second embodiment and third embodiment to be subsequently described.

Figure 8:
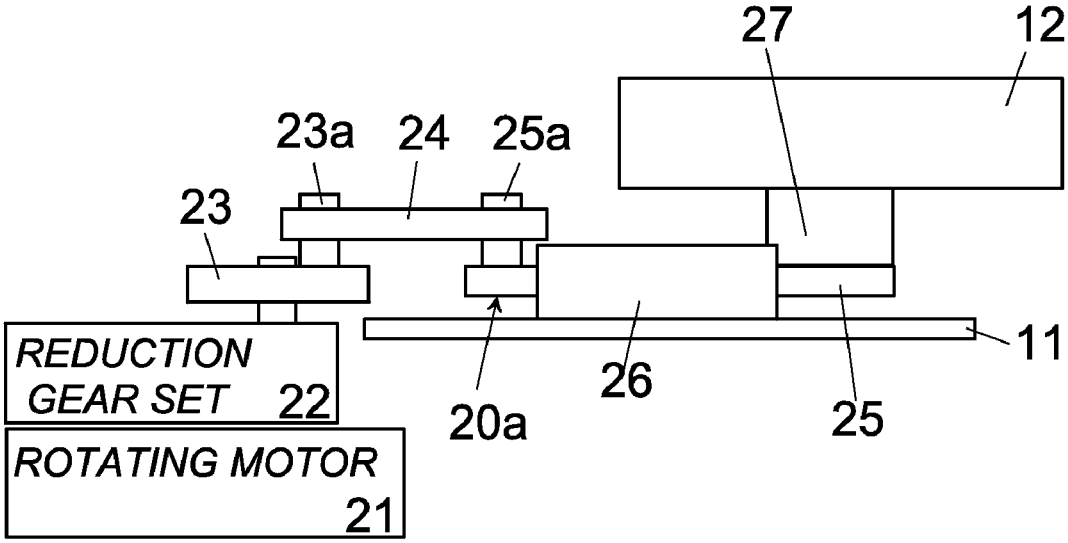
FIGS. 8(*a*) and 8(*b*) show a side view of a seat drive unit used in a device of a first embodiment of the present invention, and an overhead view that omits the seat member.
Figure 8:
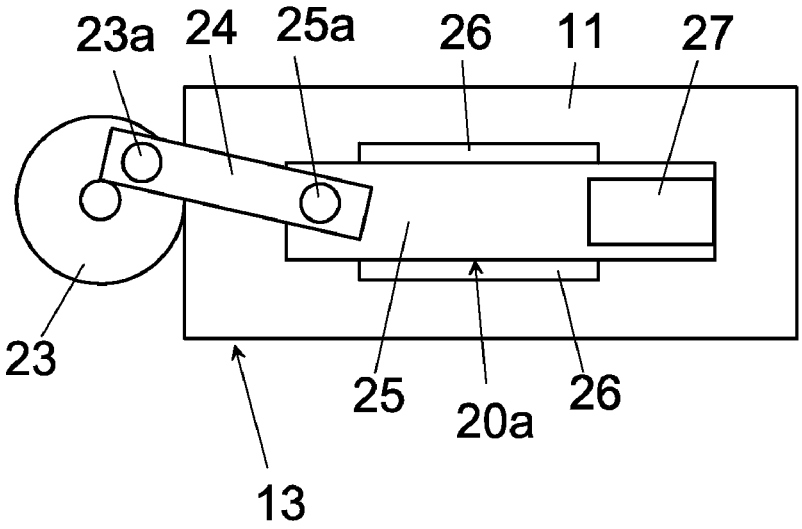

An example of the configuration of the seat drive unit 13 for causing reciprocating motion of the seat member 12 along a linear path in the lateral direction is shown in FIG. 8. The seat drive unit 13 is provided with a driving source in the form of a rotating motor 21, and rotating force of the output shaft of the rotating motor 21 is reduced by a reduction gear set 22. The rotary output of the reduction gear set 22 is transmitted to a crank plate 23. On the other hand, the seat member 12 is linked to a slider 25 through a linking mechanism 27. The slider 25 reciprocates along a linear path in the lateral direction as a result of being guided between a pair of front and rear guide plates 26. One end of a crank rod 24 is pivotally attached to one end of the slider 25 by a shaft pin 25*a*, while the other end of the crank rod 24 is pivotally attached to a crank pin 23*a* provided eccentrically on a crank plate 23. Thus, rotation of the crank plate 23 causes reciprocal movement of the slider 25 along a linear path in the lateral direction along the guide plates 26. Furthermore, although the guide plates 26 are shown fixed to the frame 11 in the example shown in the drawings to simplify the explanation, the guide plates 26 are actually fixed to a base plate mounted on the frame 11.

Use of the seat drive unit 13 having the configuration described above enables the seat member 12 to reciprocate along a linear path in the lateral direction. Since the buttocks of the user M are supported by the seat member 12 as previously described, when the seat member 12 reciprocates along a linear path in the lateral direction, the load that acts on the left and right legs of the user M due to user M's own weight varies, and exercising can be carried out that consists mainly of contracting muscle groups of the thighs.

In the present embodiment, the rotating motor 21, the reduction gear set 22, the crank plate 23, the crank rod 24, the slider 25 and the guide plates 26 constitute the linear drive 20*a* that reciprocates the seat member 12 along a linear path in the lateral direction, and since the linear drive 20*a* has this type of simple configuration, the number of components can be reduced and the device can be configured to have compact size. In addition, since the foot rest is only required to be an installation site in the manner of a floor on which the base 10 is placed, the number of components, size and price can be lowered as a result of this as well. In addition, although changes in the user M's own weight that act on the seat member 12 are small in comparison with each of the embodiments to be subsequently described since displacement of the seat member 12 is limited to that along a linear path in the lateral direction in the present embodiment, the device of the present embodiment can be easily used by a user having low exercise capacity due to the small load.

Furthermore, although the linear drive 20*a*, which converts rotary motion to linear motion with the crank plate 23, the crank rod 24, the slider 25 and the guide plates 26, is used in the present embodiment, various known mechanisms that convert rotating force of the rotating motor 21 to linear reciprocal movement in the lateral direction can be employed for the linear drive 20*a*, For example, by using a cylindrical cam having a rotating shaft in the lateral direction that rotates accompanying transmission of rotating force from the rotating motor 21, providing a cam follower that follows a cam groove formed in the peripheral surface of the cylindrical cam, and linking the seat member 12 to this cam follower, a configuration that moves the seat member 12 in the lateral direction can be employed in the form of the linear drive 20*a*.

Second Embodiment

Figure 9:
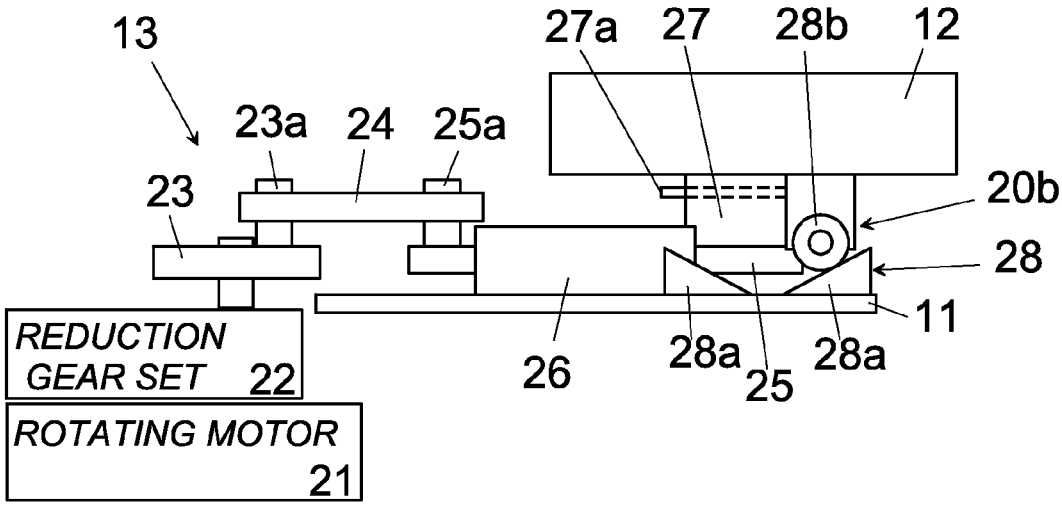
FIGS. 9(*a*) and 9(*b*) show a side view of a seat drive unit used in a device of a second embodiment of the present invention, and an overhead view that omits the seat member.
Figure 9:
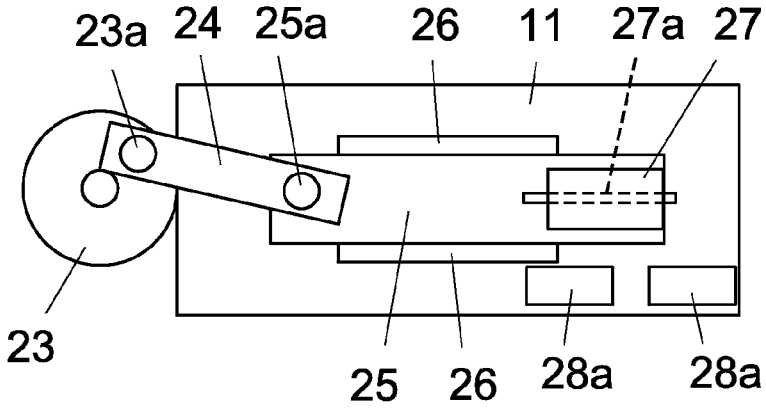

Although an example of a configuration in which the seat member 12 moves along a linear path in the lateral direction was indicated in the first embodiment, as shown in FIG. 9, swinging of the seat member 12 may be made to include a pitching operation by adding a fore-aft drive 20*b*, which displaces the seat member 12 in the lengthwise direction, to the configuration of the first embodiment. The pitching operation is not carried out independently, but rather is interlocked with lateral displacement of the seat member 12. In other words, in the present embodiment, since the seat member 12 is displaced in the lengthwise direction in addition to linear reciprocal movement in the lateral direction, changes in the load acting on the legs of the user can be increased in comparison with that of the configuration of the first embodiment, The fore-aft drive 20*b* includes a pitch axle 27*a* provided at a linking mechanism 27 of linking the slider 25 and the seat member 12, and a pitch converter 28 that generates a rotational force about the pitch axle 27*a* to the seat member 12 in accordance with the movement of the slider 25 of the linear drive 20*a*, The pitch axle 27*a* pivotally supports the seat member 12 to allow it to rotate in the lengthwise direction. The pitch converter 28 includes inclined members 28*a* each mounted on the frame 11 to have an upper inclined surface, and a roller 28*b* held on the underside of the seat member 12 to follow the upper inclined surface of the inclined member 28*a*, The roller 28*b* comes into contact with the inclined surface behind the pitch axle 27*a*, The upper inclined surface of the inclined member 28*a* extends upwardly and outwardly from a neutral position of the lateral movement range toward the end of that range. The roller 28*b* and the inclined member 28*a* are located such that the roller is kept in rolling contact with the inclined surface.

Thus, when the roller 28*b* moves up and down the inclined upper surface of the inclined member 28*a* accompanying movement of the slider 25 in the lateral direction, the seat member 12 rotates about the pitch axle 27*a*, the front of the bearing surface 12*a* lowers relative to the rear since the rear of the seat member 12 is pushed up when the roller 28*b* ascends the inclined upper surface of the inclined member 28*a*, while the front of the bearing surface 12*a* rises relative to the rear since the rear of the seat member 12 is pulled down when the roller 28*b* descends the inclined upper surface of the inclined surface 28*a*, This operation enables the seat member 12 to be displaced in the lengthwise direction. Other configurations and operations of the present embodiment are the same as those of the first embodiment.

In the present embodiment, in consideration of linear movement in the lateral direction along with displacement in the lengthwise direction by the seat member 12, the front of the bearing surface 12*a* of the seat member 12 in the vicinity of each end during lateral movement of the seat member 12 is inclined so as to be positioned at a height lower than the rear. As a result, the proportion of the user M's own weight that is supported by the seat member 12 decreases and as a result, the load that acts on the legs of the user M increases, thereby making it possible to enhance exercise effects.

Since the fore-aft drive 20*b* of the present embodiment employs a configuration in which it follows movement of the linear drive 20*a*, a driving source in the form of the rotating motor 21 is only required to be provided for the linear drive 20*a*, thereby enabling both linear reciprocal movement in the lateral direction and movement in the lengthwise direction with the single rotating motor 21. Furthermore, the configuration of the pitch converter 28 is not limited to that described above, but rather a similar operation can be realized by using a mechanism equivalent to a cam that converts linear movement of the slider 25 to rotary movement. Other configurations and operations of the present embodiment are the same as those of the first embodiment.

Third Embodiment

Although an example of a configuration in which the seat member 12 moves along a linear path in the lateral direction was indicated in the first embodiment, the present invention is configured so that rolling is included in swinging of the bearing surface 12*a* of the seat member 12 by relatively changing the heights on the left and right sides of the bearing surface 12*a* of the seat member 12. In addition, although the present embodiment includes the fore-aft drive 20*b* that displaces the seat member 12 in the lengthwise direction as in the second embodiment, a configuration can also be employed in which the fore-aft drive 20*b* is omitted and only rolling is carried out independently.

Figure 10:
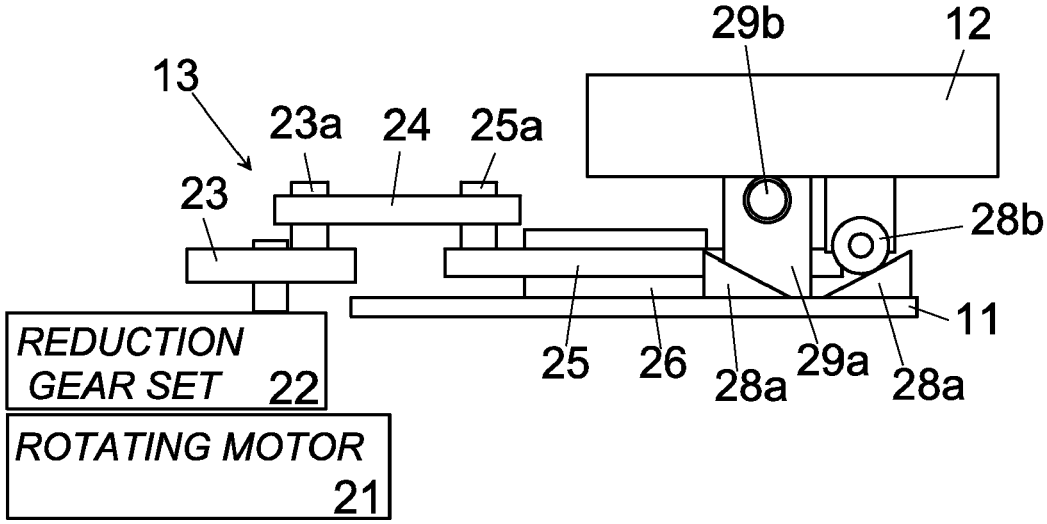
FIGS. 10(*a*) and 10(*b*) show a side view of a seat drive unit used in a device of a third embodiment of the present invention, and an overhead view that omits the seat member.
Figure 10:
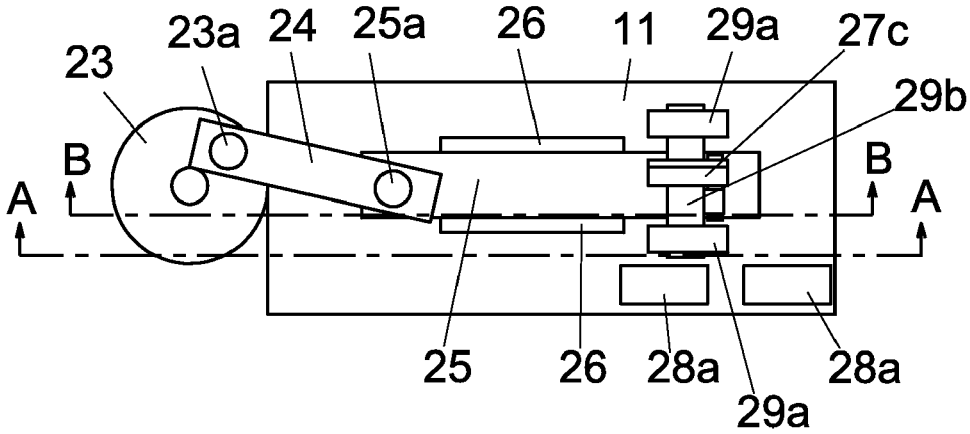
Figure 11:
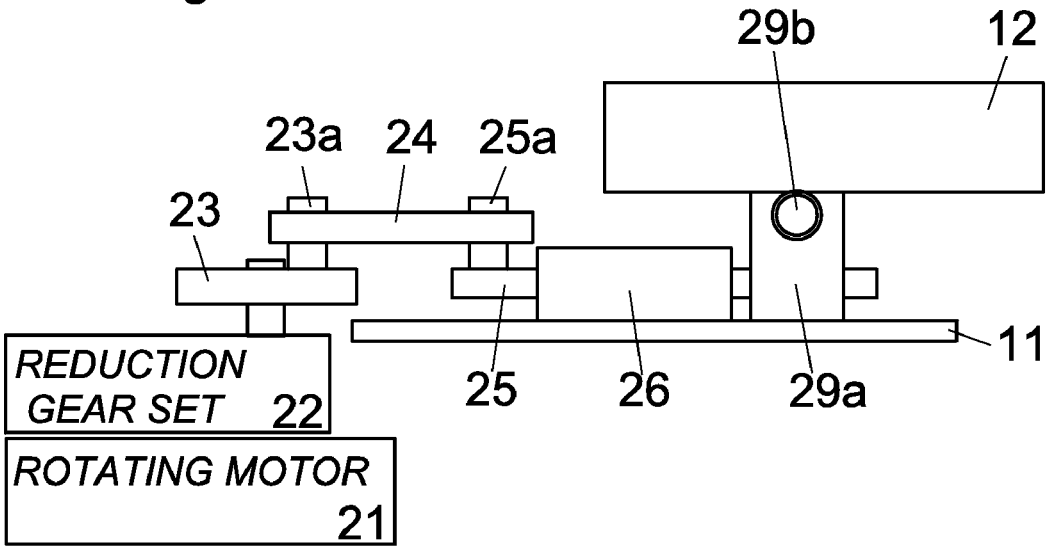
FIG. 11 is a cross-sectional view taken along line A-A of FIG. 10(*b*)
Figure 12:
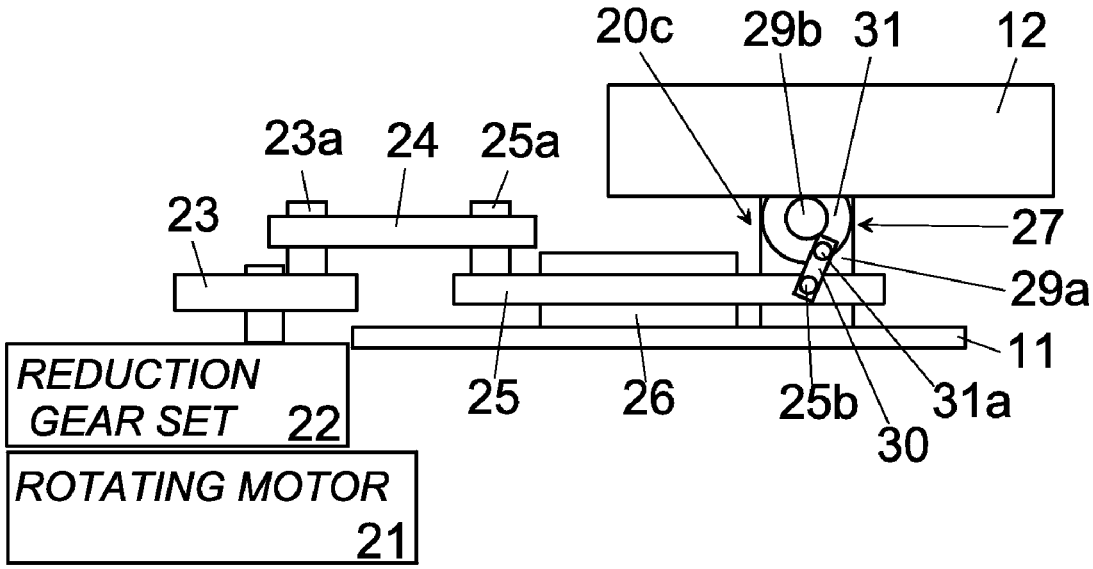
FIG. 12 is a cross-sectional view taken along line B-B of FIG. 10(*b*).

Thus, as shown in FIGS. 10 to 12, the present embodiment has for the basic configuration thereof the configuration of the linear drive 20*a* shown in the first embodiment, but instead of linearly moving the seat member 12 in the lateral direction, is provided with the inclination drive 20*c* that converts linear reciprocal movement of the slider 25 to inclination movement in the lateral direction of the bearing surface 12*a* of the seat member 12. The inclination drive 20*c* includes a roll axle 29*b* which supports the seat member to pivot in the lateral direction, and a roll converter that generates a rotating force of rotating the seat member about the roll axle while the seat member is driven by the slider 25 to move linearly in the lateral direction. In the present embodiment, the rotating motor 21, the reduction gear set 22, the crank plate 23, the crank rod 24, the slider 25, and the guide plate 26 constitute the linear drive 20*a* which does not give a truly translational movement to the seat member 12. Nevertheless, the linear drive 20*a* has the similar function. Therefore, the linear drive 20*a* is labeled with the identical reference numerals and the explanation thereof is omitted.

The roll converter includes a rotor plate 31 coupled to the seat member 12 to be rotatable together with the roll axle 29*b*, a pivot pin 25*b* provided on the side of the slider 25, a crank link 30 coupling a crank pin 31*a* and the pivot pin 25*b*, The roll axle 29*b* is pivotally supported at its opposite ends to a pair of axle support plates 29*a* fixed to the frame 11.

When the rotating motor 21 is activated to reciprocate the slider 25 linearly along the lateral direction, the rotor plate 31 coupled to the slider 25 by way of the crank link 30 is caused to rotate, whereby the seat member 12 is driven to rotate in the lateral direction. That is, the bearing surface 12*a*, which is the upper surface of the seat member 12, makes a combination movement of the lateral linear movement and the rolling movement.

In the configuration of the present embodiment, since the heights on the left and right ends of the bearing surface 12*a* of the seat member 12 change relative to each other, the torso of the user M is inclined to the left and right, and the change in the load that acts on the left and right legs of the user M accompanying movement of the seat member 12 becomes comparatively large. Other configurations and operations are the same as those of the first embodiment.

The invention claimed is:

1. An exercise assisting device comprising:

a seat member having a bearing surface configured to support buttocks of a user with one's feet placed on a predetermined foot rest; and a seat drive unit configured to activate a driving source to displace said seat member in such a manner as to vary a user's own weight acting on legs of the user, wherein said seat drive unit is configured to swing said seat member at least along a lateral direction, and said seat drive unit includes a linear drive configured to swing said seat member along a linear path along the lateral direction, wherein said seat drive unit includes a fore-aft drive configured to give a pitching operation to said seat member about a pitch axle of the fore-aft drive with respect to a lengthwise direction in an interlocked manner with the lateral swinging movement of said seat member, and wherein said fore-aft drive comprising a pitch axle which pivotally supports said seat member to allow the seat member to rotate about said pitch axle, and a pitch converter configured to generate a rotating force of rotating the seat member about the pitch axle in accordance with the lateral movement of the seat member along the linear path caused by said linear drive.

2. An exercise assisting device as set forth in claim 1, wherein said seat drive unit includes an inclination drive configured to swing said seat member in such a manner as to incline the bearing surface with respect to the lateral direction to differentiate the heights of the lateral ends of said seat member with each other.

3. An exercise assisting device as set forth in claim 2, wherein said inclination drive is configured to give a rolling movement to said seat member about a lengthwise axis in an interlocked manner with the lateral swinging movement of said seat member.

4. An exercise assisting device comprising:

a seat member having a bearing surface configured to support buttocks of a user with one's feet placed on a predetermined foot rest; and a seat drive unit configured to activate a driving source to displace said seat member in such a manner as to vary a user's own weight acting on legs of the user, wherein said seat drive unit is configured to swing said seat member at least along a lateral direction, and said seat drive unit includes a linear drive configured to swing said seat member along a linear path along the lateral direction, wherein said seat drive unit includes a fore-aft drive configured to give a pitching operation to said seat member about a pitch axle of the fore-aft drive with respect to a lengthwise direction in an interlocked manner with the lateral swinging movement of said seat member, wherein said seat drive unit includes an inclination drive configured to swing said seat member in such a manner as to incline the bearing surface with respect to the lateral direction to differentiate the heights of the lateral ends of said seat member with each other, wherein said inclination drive is configured to give a rolling movement to said seat member about a lengthwise axis in an interlocked manner with the lateral swinging movement of said seat member, and wherein said exercise assisting device further comprises a pitch converter having inclined members each being mounted on a frame to have an upper inclined surface, and a roller provided on the side of said seat member, said roller being configured to come into a rolling contact with the upper inclined surface of the inclined member behind said pitch axle, and wherein the upper inclined surface of each said inclined member extending outwardly and upwardly from the center of a lateral swinging range of the seat member towards the end thereof.

5. An exercise assisting device as set forth in claim 3, wherein said pitch converter comprises inclined members each being mounted on a frame to have an upper inclined surface, and a roller provided on the side of said seat member, said roller being configured to come into a rolling contact with the upper inclined surface of the inclined member behind said pitch axle, and wherein the upper inclined surface of each said inclined member extending outwardly and upwardly from the center of a lateral swinging range of the seat member towards the end thereof.

6. An exercise assisting device comprising:

a seat member having a bearing surface configured to support buttocks of a user with one's feet placed on a predetermined foot rest; and a seat drive unit configured to activate a driving source to displace said seat member in such a manner as to vary a user's own weight acting on legs of the user, wherein said seat drive unit is configured to swing said seat member at least along a lateral direction, and said seat drive unit includes a linear drive configured to swing said seat member along a linear path along the lateral direction, wherein said seat drive unit includes a fore-aft drive configured to give a pitching operation to said seat member about a pitch axle of the fore-aft drive with respect to a lengthwise direction in an interlocked manner with the lateral swinging movement of said seat member, wherein said seat drive unit includes an inclination drive configured to swing said seat member in such a manner as to incline the bearing surface with respect to the lateral direction to differentiate the heights of the lateral ends of said seat member with each other, wherein said inclination drive is configured to give a rolling movement to said seat member about a lengthwise axis in an interlocked manner with the lateral swinging movement of said seat member, and wherein said inclination drive includes a roll axle which supports the seat member to pivot thereabout in the lateral direction, and a roll converter that generates a rotating force of rotating the seat member about the roll axle while the seat member is driven by a slider to move linearly in the lateral direction, said roll converter including a rotor plate coupled to the seat member to be rotatable together with the roll axle, a pivot pin provided on the side of the slider, a crank link coupling the pivot pin and a crank pin of the rotor plate, said roll axle being pivotally supported at its opposite ends to a pair of axle support plates fixed to said frame.

7. An exercise assisting device as set forth in claim 3, wherein said inclination drive includes a roll axle which supports the seat member to pivot thereabout in the lateral direction, and a roll converter that generates a rotating force of rotating the seat member about the roll axle while the seat member is driven by a slider to move linearly in the lateral direction, said roll converter including a rotor plate coupled to the seat member to be rotatable together with the roll axle, a pivot pin provided on the side of the slider, a crank link coupling the pivot pin and a crank pin of the rotor plate, said roll axle being pivotally supported at its opposite ends to a pair of axle support plates fixed to said frame.

* * * * *